US006383290B1

(12) United States Patent
Davis et al.

(10) Patent No.: US 6,383,290 B1
(45) Date of Patent: May 7, 2002

(54) BOWLING LANE DRESSING APPLICATION MECHANISM

(75) Inventors: Mark E. Davis; John M. Davis, both of Sebring, FL (US)

(73) Assignee: The Kegel Company, Inc., Sebring, FL (US)

( * ) Notice: Subject to any disclaimer, the term of this patent is extended or adjusted under 35 U.S.C. 154(b) by 0 days.

(21) Appl. No.: 09/524,137

(22) Filed: Mar. 10, 2000

(51) Int. Cl.[7] ..... B05C 1/00; A47L 11/19

(52) U.S. Cl. ..... 118/207; 118/244; 118/262; 118/264; 15/50.3; 15/4; 15/98; 15/320

(58) Field of Search ..... 118/207, 244, 118/249, 262, 264; 15/50.3, 4, 98, 320

(56) References Cited

U.S. PATENT DOCUMENTS 4,980,815 A 12/1990 Davis ..... 364/140
5,181,290 A 1/1993 Davis et al. ..... 15/98
5,650,012 A 7/1997 Davis ..... 118/681
5,729,855 A 3/1998 Davis ..... 15/50.3

*Primary Examiner*—Laura Edwards
(74) *Attorney, Agent, or Firm*—Hovey Williams LLP

(57) ABSTRACT

The oil application mechanism of a lane conditioning machine has a moving dispensing head that deposits intermittent streams of oil onto the rotating surface of a transfer roller under the control of a programmed control system as the machine moves down the lane. The transfer roller, in turn, transfers the oil to a rotating bristle-type applicator roller that engages the lane and lays down an oil film having a cross-sectional configuration that corresponds to a preselected pattern established by the control system. A smoothing assembly engages the oil immediately after it is deposited on the transfer roller and before it reaches the applicator roller so as to extend the deposit of oil completely around the circumference of the transfer roller in an even layer. The smoothing assembly includes a series of independent, spring-loaded pad units along the length of the transfer roller, each of which includes a section of fabric with a raised nab engaging the surface of the transfer roller.

15 Claims, 3 Drawing Sheets

FIG. 2.
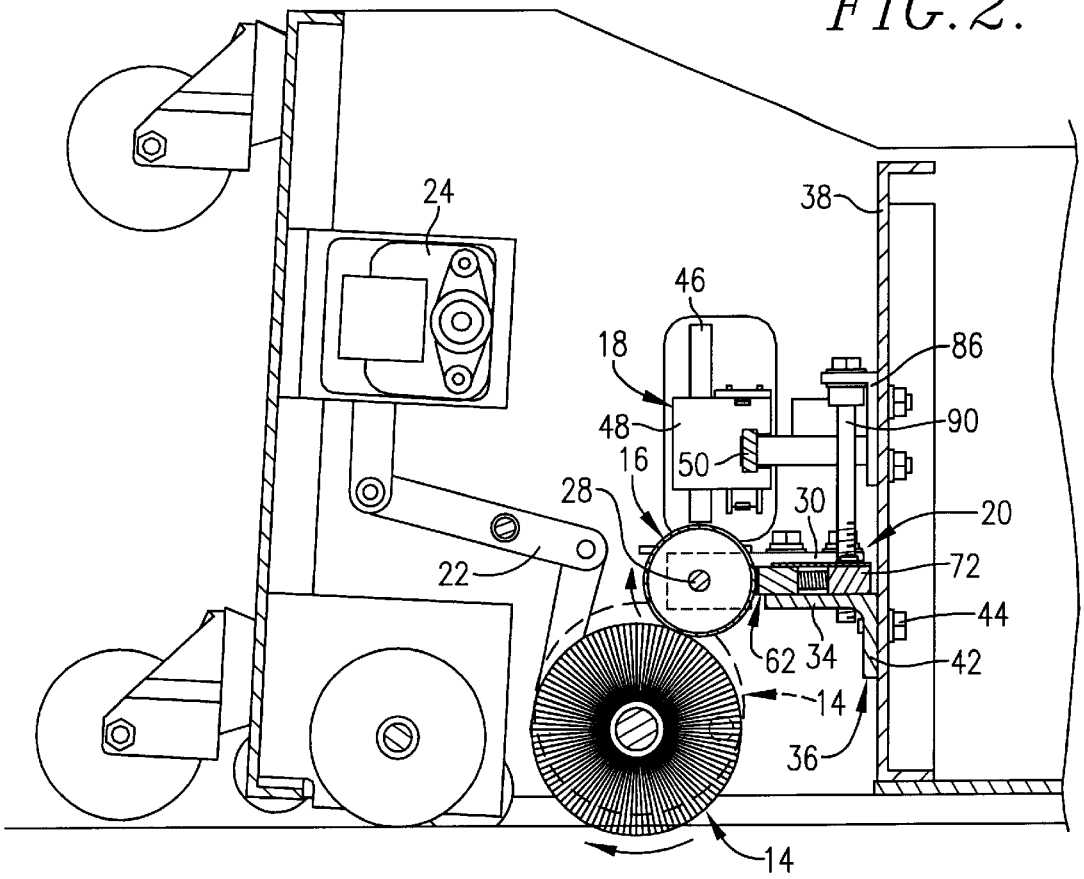
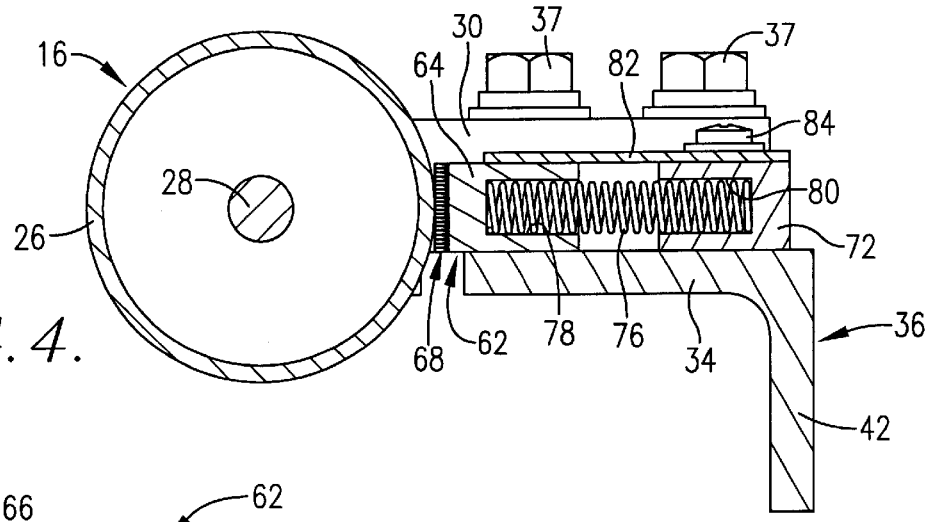
FIG. 4.
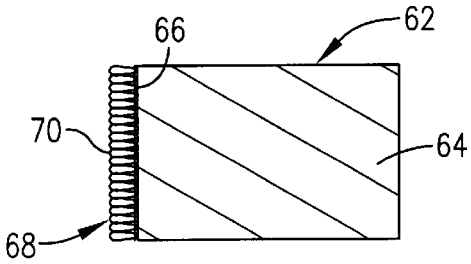
FIG. 5.

BOWLING LANE DRESSING APPLICATION MECHANISM

TECHNICAL FIELD

The present invention relates to the field of bowling lane maintenance equipment, and more particularly, to machines that apply lane dressing, such as conditioning oil, to lane surfaces as the machines travel up and down the lanes between the foul line and pin deck area.

BACKGROUND

Machines that apply conditioning oil to bowling lanes typically use a rotating bristle brush-type roller to engage the lane surface and transfer oil thereto from the machine as it travels lengthwise along the lane. Such bristle rollers are usually referred to as applicator rollers and have oil applied thereto by a hard metal transfer roller. The transfer roller, in turn, may receive its oil from one or more digitally controlled dispensing heads that move along the length of the transfer roller and dispense a stream of oil onto its rotating surface. The oil is applied to the transfer roller in preselected amounts that vary along the length of the roller so that, ultimately, the pattern of oil applied to the lane by the applicator roller corresponds to a preselected pattern. Examples of machines that utilize the digitally controlled dispensing head technology are disclosed in U.S. Letters Pat. No. 4,980,815 and 5,729,855, both assigned to the assignee of the present invention.

Due to the moving nature of the dispensing head, the oil deposited on the transfer roller in any particular zone along its length tends to be fairly concentrated in one circumferential location rather than distributed evenly around the entire circumference in that zone. It is believed that this circumstance sometimes causes the oil in any particular zone to be applied unevenly to the lane as the machine is moving along its length. This results in less than optimum playing conditions, including erratic and unpredictable behavior of the bowling ball as it travels through uneven levels of oil along the lane.

SUMMARY OF THE INVENTION

The present invention overcomes this problem through the provision of a smoothing assembly that evens out the concentration of oil in a particular zone around the entire circumference of the transfer roller so that, within that particular zone, the applicator roller carries a generally uniform volume of oil around its entire circumference. Although the oil stream tends to be applied to the transfer roller in a rather localized manner, the smoothing assembly has the effect of extending the deposited oil on around the entire circumference of the transfer roller in a even layer, ultimately resulting in a more even application of oil to the lane surface by the applicator roller.

In its preferred form, the smoothing assembly comprises a series of independent, spring-loaded pad units along the length of the transfer roller that lightly engage corresponding sections of the transfer roller to physically wipe and spread the oil about the circumference of the roller as it is rotating relative to the pad units. Preferably, the pad units are disposed to engage the newly deposited oil immediately after it arrives on the transfer roller and before it reaches the applicator roller. Furthermore, each pad unit preferably has a contacting face comprised of fabric having a raised nap, preferably in the nature of a multiplicity of fibrous loops.

BRIEF DESCRIPTION OF THE DRAWINGS

FIG. 2 is an enlarged, fragmentary cross-sectional view of the machine taken substantially along line 2—2 of FIG. 1;

FIG. 4 is an enlarged transverse cross-sectional view through the transfer roller and smoothing assembly;

FIG. 5 is a further enlarged transverse cross-sectional view of one of the pad units of the smoothing assembly;

DETAILED DESCRIPTION

Figure 1:
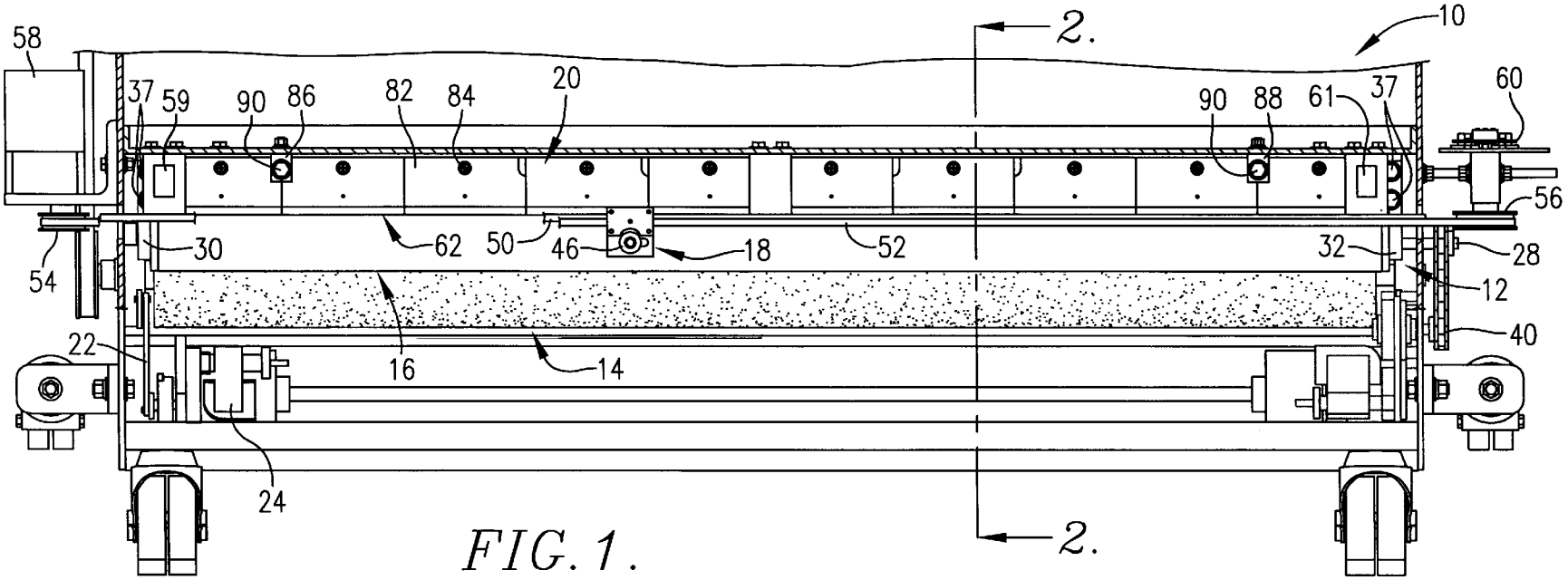
FIG. 1 is a fragmentary top plan view of a maintenance machine with its cover removed and incorporating applicator mechanism in accordance with the present invention.
Figure 3:
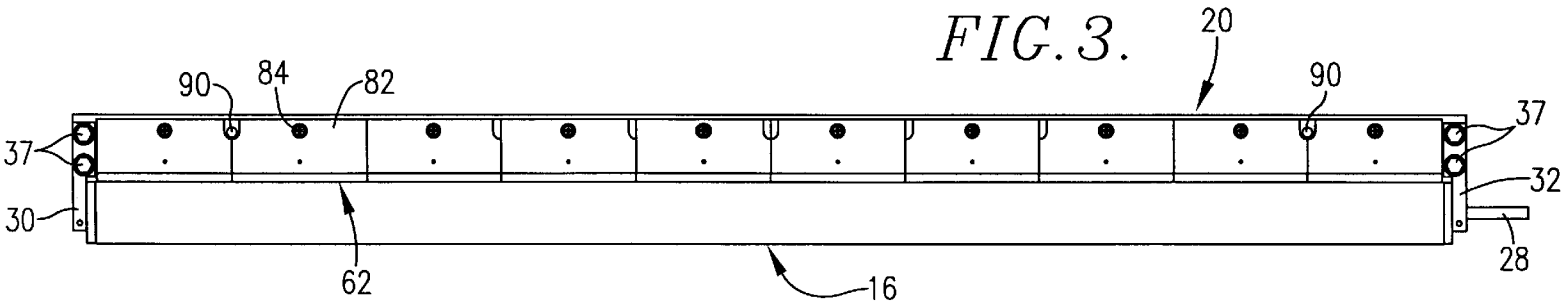
FIG. 3 is a top plan view of the transfer roller and associated smoothing assembly of the machine.

As the present invention may be embodied in many different forms, preferred embodiments of the invention are disclosed only for exemplary purposes in the drawings and the following description. Thus, the invention should not be construed as limited to the particular embodiments shown and described herein.

The conditioning machine 10 in FIG. 1 is similar in many respects to the machine disclosed in U.S. Pat. No. 5,729,855. Therefore, the '855 patent is hereby incorporated by reference into the present specification. In view of the full disclosure in the '855 patent of the nature and operation of the lane machine, many constructional details of the machine 10 will not be repeated herein.

The improvement in machine 10 to which the present invention is directed resides in the oil application mechanism which is broadly denoted by the numeral 12 in FIG. 1. Broadly speaking, and referring initially to FIGS. 1 and 2, such mechanism 12 includes an applicator roller 14, a transfer roller 16, an oil dispensing head 18, and a smoothing assembly 20. As well understood by those skilled in the art, the applicator roller 14 comprises a bristle brush-type roller having bristles that are fabricated from a synthetic resinous material, such roller being available, for example, from IBC International Brush Corporation of Lakeland, Fla. Applicator roller 14 is supported by linkage 22 for raising and lowering movement between a lowered lane-contacting position as shown in solid lines in FIG. 2 and a raised, out-of-contact position as shown in phantom lines in that same figure. A motor 24 operates the linkage 22 to in turn raise and lower the applicator roller 14. Applicator roller 14 rotates in a clockwise direction viewing FIG. 2 during operation.

Applicator roller 14 is always in contact with transfer roller 16, regardless of whether applicator roller 14 is in its raised or lowered position. Due to the resilient nature of the bristles, the periphery of applicator roller 14 becomes depressed by the transfer roller 16 to a greater or lesser extent, depending upon the position of applicator roller 14. Transfer roller 16 is tubular and has a hard external wall 26 constructed of stainless steel with a sand-blasted textured finish. Transfer roller 16 also rotates in a clockwise direction viewing FIG. 2 during operation.

Figures 6, 7:
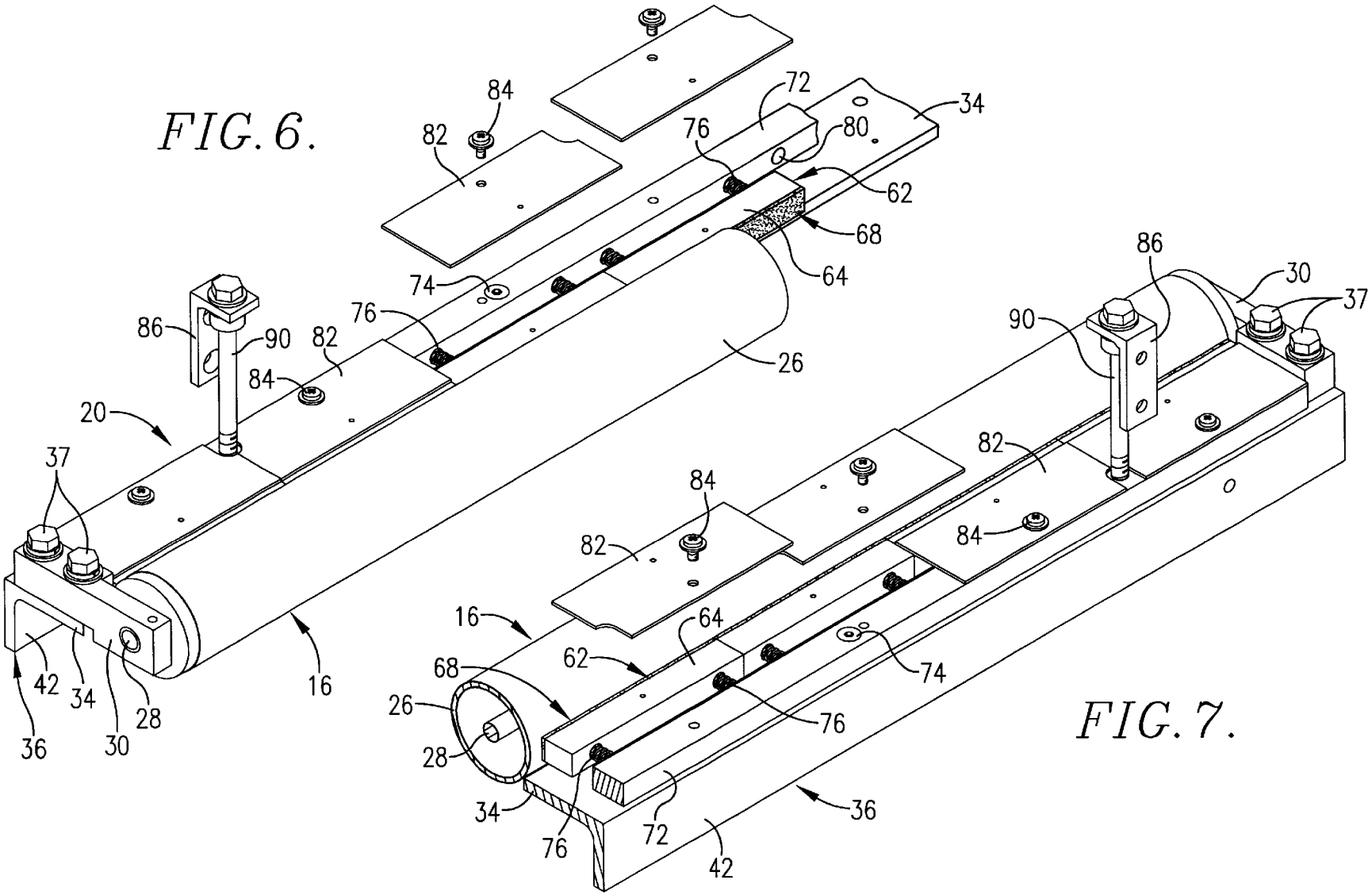
FIG. 6 is a fragmentary, partially exploded isometric view of the transfer roller and smoothing assembly as viewed from one side of the transfer roller.
FIG. 7 is a fragmentary, partially exploded isometric view of the transfer roller and smoothing assembly as viewed from the opposite side of the transfer roller.

Transfer roller 16 has a central shaft 28 extending axially therethrough. Shaft 28 is journalled at its opposite ends by a pair of fore-and-aft extending arms 30 and 32 (see FIGS. 6 and 7 for details of arm 30) that are fastened to the horizontally extending leg 34 of an inverted L-shaped support bar 36 secured to an upstanding, transverse wall 38 within the housing of machine 10. Bolts 37 fasten arms 30, 32 to bar 36. The bar 36 extends essentially the full width of the machine housing. At its end that is supported by arm 30, the shaft 28 of transfer roller 14 terminates flush with the outboard surface of arm 30, while at its end that is supported by arm 32, shaft 28 projects outwardly beyond arm 32 to the exterior of the housing where it is coupled with a chain and sprocket drive assembly 40. The vertical leg 42 of support bar 36 is secured to wall 38 by bolts 44 that pass through appropriate vertical slots (not shown) in either wall 38 or vertical leg 42 to permit vertical adjustment of support bar 36 as will hereinafter be explained in more detail.

Dispensing head 18 includes an upright, tubular nozzle 46 that is connected via a tubular supply hose (not shown) with a source of metered oil supply (not shown), including a digitally controlled metering pump and a reservoir. A block-like holder 48 carries the nozzle 46 a short distance above the transfer roller 16 and in vertical registration with shaft 28. Head 18 is mounted on a transversely extending, horizontal guide track 50 that extends across the full width of the machine above and parallel to transfer roller 16. An endless drive belt 52 is secured at its opposite ends to head 18 and is entrained around a pair of pulleys 54 and 56 located outboard of the opposite side walls of the machine housing. Pulley 54 is driven by a reversible motor 58, which is controlled by left and right proximity sensors 59 and 61 at opposite limits of travel of head 18. A notched timing wheel 60 associated with the pulley 56 cooperates with sensors (not shown) to sense the rotation of timing wheel 60 in order to sense the position of head 18 along its path of travel. Motor 58 thus drives head 18 back and forth across the machine and along the length of the transfer roller 16, while streams of oil are intermittently dispensed by nozzle 46 onto the rotating upper periphery of transfer roller 16 in accordance with a predetermined oil pattern controlled by the control system (not shown) of the machine. Although head 18 moves the full length of transfer roller 16 during each pass along the roller, head 18 may or may not be dispensing oil to roller 16 at any given instant in time depending upon the position of head 18 along roller 16, the position of the machine on the lane, and the oil pattern selected by the user.

Smoothing assembly 20 includes a series of ten independent, spring-loaded pad units 62 along the length of transfer roller 16 that engage the periphery of roller 16 on the downturning side thereof. In the preferred embodiment, pad units 62 are non-rotating, although the principles of the present invention are not necessarily limited to non-rotating units. Each pad unit 62 in its preferred form comprises a metal block 64 having a front, rectangular face 66 to which is affixed a rectangular section of fabric 68, preferably having a raised nap. Preferably, the nap of fabric 68 comprises a multiplicity of fibrous loops 70 as shown in FIG. 5. One type of fabric that has been particularly suitable in this regard is the loop fabric of the well-known hook and loop fastening fabric sold under the trademark VELCRO and available from Velcro USA, Inc. of Manchester, N.H. (part number 191195, 100% NYLON). Such loop fabric having a pre-applied adhesive with a peel-off cover has been found to work well.

The density of the loop fabric seems to affect the smoothing action imparted by assembly 20. If the desired result is not obtained with the particular lane oil being used under the conditions existing in the particular bowling center involved, a fabric with a greater or lesser density than the above noted example may be utilized. Alternatively, sprinkling NYLON powder onto the interface between the fabric and the transfer roller 16 may be useful in some conditions to slightly raise the density of the existing fabric without employing a different material.

The pad units 62 are slidably supported on the top surface of the horizontal leg 34 of support bar 36. An elongated backing bar 72 also rests upon the leg 34 and extends virtually the full length of the support bar 36, terminating at its opposite ends just inboard of the arms 30 and 32. Screws 74 at periodic locations along the backing bar 72 secure the backing bar to the support bar 36. Backing bar 72 is spaced transversely from the series of pad units 62, and a pair of coiled compression springs 76 are interposed between each pad unit 62 and backing bar 72 for yieldably biasing the pad unit toward transfer roller 16. As illustrated in FIG. 4, one end of each spring 76 is received within a socket 78 in the block 64 of pad unit 62, while the opposite end of each spring 76 is received within a socket 80 in the backing bar 72. The two springs 76 for each pad unit 62 are disposed generally adjacent opposite ends of the corresponding block 64 to provide an essentially uniform biasing force against the pad unit 62 along its entire length. Springs 76 are light duty springs, preferably having a spring rate of approximately one pound per inch. In one exemplary embodiment, a spring rate of 1.213 pounds per inch has been found to be satisfactory.

Each pad unit 62 has its own cover plate 82 that overlies backing bar 72 and most of block 64. Each plate 82 is secured to backing bar 72 by a screw 84 so as to be rigidly affixed thereto. However, the distal end of each plate 82 is not secured to the pad unit 62 therebeneath so that plate 82 merely confines unit 62 but does not prevent its biasing movement toward transfer roller 16. A pair of inverted, L-shaped brackets 86 and 88 secured to upright wall 38 at or near opposite ends of support bar 36 each carry an adjusting bolt 90 that passes downwardly through backing bar 72 and is threadably received by horizontal leg 34 of support bar 36. Thus, when bolts 44 are loosened, the height of backing bar 36, and thus also the height of transfer roller 16, can be adjusted by rotating the appropriate one or both of adjusting bolts 90.

OPERATION

As set forth in detail in U.S. Pat. No. 5,729,855, the conditioning machine 10 can be pre-programmed to lay down a wide variety of oil patterns. Generally speaking, the oil pattern will have a certain preselected configuration as viewed in transverse cross-section across the lane, will extend for a certain preselected length along the lane, and will have a certain preselected configuration as viewed in longitudinal cross-section along the lane. The amount of oil loaded onto the bristles of applicator roller 14 at the different zones along its length determines the transverse configuration of the pattern. The longitudinal configuration of the pattern depends in part on how long applicator roller 14 remains in contact with the lane after all oil flow has been terminated at dispensing head 18, it being noted that a feathering or gradual tapering of the depth of the oil film can be achieved after head 18 stops dispensing oil due to the residual amounts of oil still held by the bristles of applicator roller 14. On the other hand, the pattern can be terminated abruptly rather than feathered by simply raising applicator roller 14 to its raised position out of contact with the lane.

As the machine travels along the lane, in either forward or reverse, and assuming the rotating applicator roller 14 is contacting the lane, dispensing head 18 is continuously moving back and forth along the full length of the rotating transfer roller 16. Depending upon the program that has been selected, and the position of the machine along the length of the lane, head 18 either dispenses oil or does not dispense oil to certain zones of the transfer roller as it passes over those zones during each pass. Consequently, carefully controlled amounts of oil are transferred to the different zones of applicator roller 14 by transfer roller 16, resulting in the pre-selected oil pattern being laid down on the lane.

Because dispensing head 18 is moving as it passes over a zone on transfer roller 16, it leaves the zone before the entire circumference of roller 16 in the zone can rotate under the nozzle 46. Thus, head 18 tends to leave its stream of oil at only a limited circumferential location in the zone during each pass. However, immediately after being deposited on transfer roller 16, the oil encounters smoothing assembly 20, which engages the deposited oil and extends it evenly around the remaining circumference of the roller so that an even layer of oil is presented to applicator roller 14.

The deposited oil does not pool on pad units 62. Instead, due to the light pressure from springs 76 and the nature of the fibrous loops 70, most of the deposited oil tends to pass through fibrous loops 70 and be presented to applicator roller14. To the extent the deposited oil is excessively localized, however, it is retained by fibrous loops 70 and spread over the remaining circumference of the transfer roller 16 within the zone as the surface of roller 16 rotates under the pad unit 62. Consequently, an accurate, even layer of oil within each zone of the oil pattern is applied to the lane.

The preferred forms of the invention described above are to be used as illustration only, and should not be utilized in a limiting sense in interpreting the scope of the present invention. Obvious modifications to the exemplary embodiments, as herein above set forth, could be readily made by those skilled in the art without departing from the spirit of the present invention.

The inventors hereby state their intent to rely on the doctrine of equivalents to determine and assess the reasonably fair scope of the present invention as pertains to any apparatus not materially departing from but outside the literal scope of the invention as set forth in the following claims.

What is claimed is:

1. In a bowling lane conditioning machine for applying liquid dressing to a lane surface as the machine travels along the lane, improved application mechanism comprising:

a rotatable transfer roller;

a dispensing head movable axially along the transfer roller and operable to place a metered deposit of dressing onto the transfer roller while the transfer roller is rotating;

a smoothing assembly contacting the transfer roller to extend the deposit circumferentially around the transfer roller, said smoothing assembly being non-rotating; and a rotatable applicator roller disposed in contacting engagement with the transfer roller for receiving dressing therefrom and for transferring a film of oil to the lane surface.

2. In a lane conditioning machine as claimed in claim 1, said transfer roller having a downturning side that turns generally away from the dispensing head and toward the applicator roller, said smoothing assembly being located to engage the transfer roller on said downturning side.

3. In a lane conditioning machine as claimed in claim 1, said transfer roller and said applicator roller being driven in the same direction.

4. In a lane conditioning machine as claimed in claim 1, said applicator roller having a body of synthetic resinous bristles.

5. In a bowling lane conditioning machine for applying liquid dressing to a lane surface as the machine travels along the lane, improved application mechanism comprising:

a rotatable transfer roller;

a dispensing head movable axially along the transfer roller and operable to place a metered deposit of dressing onto the transfer roller while the transfer roller is rotating;

a smoothing assembly contacting the transfer roller to extend the deposit circumferentially around the transfer roller; and a rotatable applicator roller disposed in contacting engagement with the transfer roller for receiving dressing therefrom and for transferring a film of oil to the lane surface, said transfer roller having a downturning side that turns generally away from the dispensing head and toward the applicator roller, said smoothing assembly being located to engage the transfer roller on said downturning side, said smoothing assembly including a pad unit having a section of fabric material with a raised nap.

6. In a lane conditioning machine as claimed in claim 5, said raised nap including a multiplicity of fibrous loops.

7. In a lane conditioning machine as claimed in claim 5, said pad unit being yieldably biased toward the transfer roller.

8. In a lane conditioning machine as claimed in claim 7, said pad unit comprising one of a series of separate pad units along the length of the transfer roller, each of said pad units being individually yieldably biased toward the transfer roller.

9. In a lane conditioning machine as claimed in claim 8, said raised nap including a multiplicity of fibrous loops.

10. In a bowling lane conditioning machine for applying liquid dressing to a lane surface as the machine travels along the lane, improved application mechanism comprising:

a rotatable transfer roller;

a dispensing head movable axially along the transfer roller and operable to place a metered deposit of dressing onto the transfer roller while the transfer roller is rotating;

a smoothing assembly contacting the transfer roller to extend the deposit circumferentially around the transfer roller; and a rotatable applicator roller disposed in contacting engagement with the transfer roller for receiving dressing therefrom and for transferring a film of oil to the lane surface, said smoothing assembly including a pad unit having a section of fabric material.

11. In a lane conditioning machine as claimed in claim 10, said pad unit being yieldably biased toward the transfer roller.

12. In a lane conditioning machine as claimed in claim 11, said pad unit comprising one of a series of separate pad units along the length of the transfer roller, each of said pad units being individually yieldably biased toward the transfer roller.

13. In a lane conditioning machine as claimed in claim 12, said raised nap including a multiplicity of fibrous loops.

14. In a lane conditioning machine as claimed in claim 10, said fabric material having a raised nap.

15. In a lane conditioning machine as claimed in claim 14; and powder on said raised nap.

* * * * *